US005429347A

United States Patent [19]

Leonard

[11] Patent Number: 5,429,347

[45] Date of Patent: Jul. 4, 1995

[54] DEVICE FOR UNIT DISTRIBUTION OF THIN STACKED OBJECTS

[75] Inventor: Francois Leonard, Caluire et Cuire, France

[73] Assignee: Bertin & Cie, Plaisir, France

[21] Appl. No.: 145,696

[22] Filed: Nov. 3, 1993

[30] Foreign Application Priority Data

Nov. 5, 1992 [FR] France ..... 92 13322

[51] Int. Cl.[6] ..... B65H 3/12

[52] U.S. Cl. ..... 271/94; 271/111; 271/265.01

[58] Field of Search ..... 271/94, 96, 110, 111, 271/112, 114, 265, 270; 414/795.4, 797, 797.3

[56] References Cited

U.S. PATENT DOCUMENTS 4,077,620 3/1978 Frank et al. ..... 271/265
4,357,007 11/1982 Franciscus et al. .
4,449,705 5/1984 Shibuya et al. .
4,573,673 3/1986 Haug ..... 271/111
5,056,771 10/1991 Beck et al. ..... 271/114
5,172,900 12/1992 Uno et al. ..... 271/270
5,197,726 3/1993 Nogami ..... 271/110

FOREIGN PATENT DOCUMENTS 3531145 3/1987 Germany .

*Primary Examiner*—H. Grant Skaggs
*Attorney, Agent, or Firm*—Watson, Cole, Grindle & Watson

[57] ABSTRACT

A device for unit distribution of thin stacked objects such as letters which reduces the interval between distributed objects includes a rotating drum for contacting and accelerating a leading object from the stack through a slot, a speed sensor for measuring the instantaneous speed of the leading object as it is ejected by the drum through the slot, and an automation unit for controlling the driving of the next object by the drum as a function of the speed of the leading object.

14 Claims, 4 Drawing Sheets

| | Object state | E 46 | $E_{\omega min}$ | $E_{\omega max}$ | OBJECT POSITION | Time delay |
|---|---|---|---|---|---|---|
| $P_1$ | Initial state | 0 | 0 | 0 | 2 | $T_1$ |
| $P_2$ | Exit of FR. E | 1 | 0 | 0 | | $T_2$ |
| $P_3$ | DET.MOT Roller | 1 | 1 | 0 | | $T_3$ |
| $P_4$ | Synchro. nization | 1 | 1 | 1 | | $T_4$ |
| $P_5$ | Object end Prediction | 1 | 1 | 0 | | $T_5$ |
| $P_6$ | Passage of RE. E | 0 | 0 | 0 | 2 | $T_6$ |

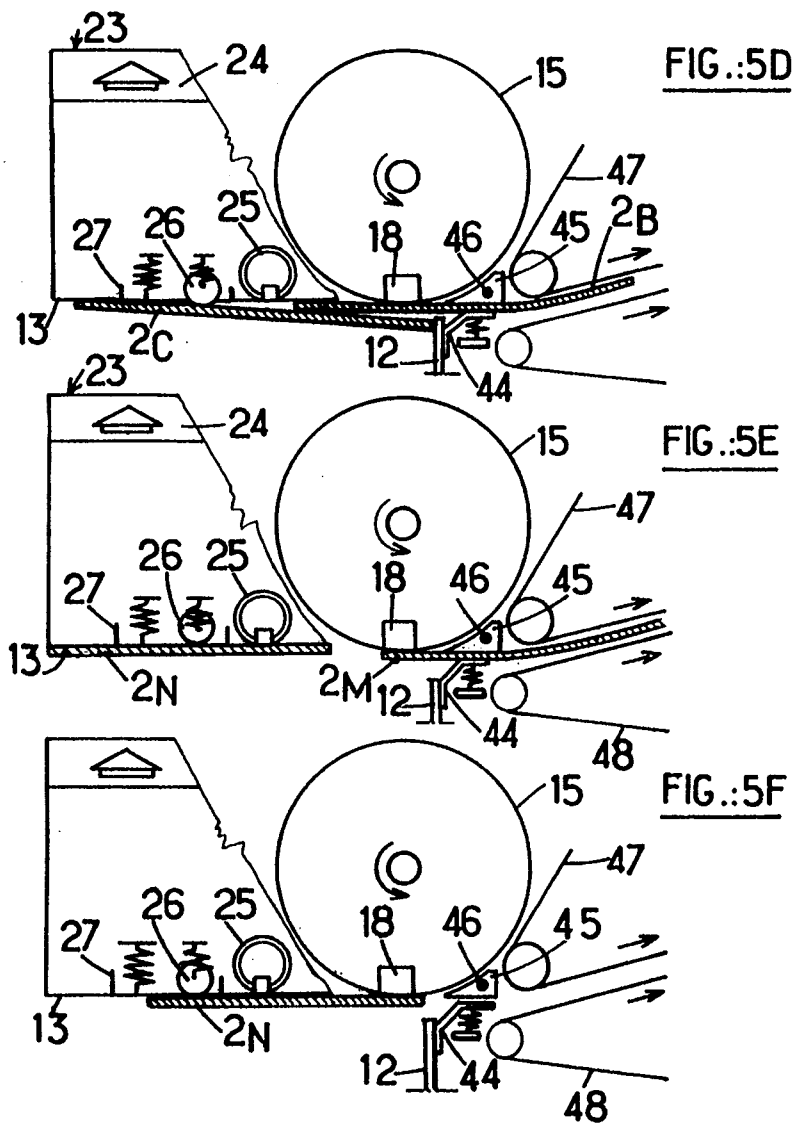
FIG.:5D
FIG.:5E
FIG.:5F
15
47
2B
45
46
44
18
12
24
25
26
27
23
13
2C
2M
2N
48
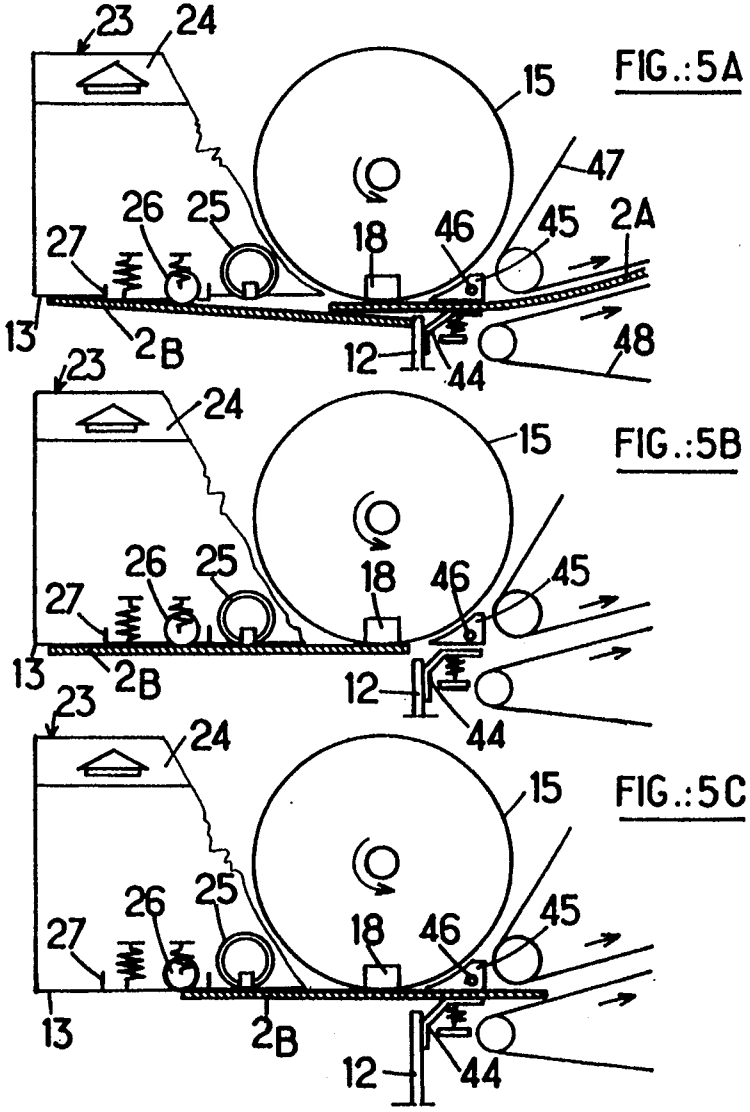
FIG.:5A
FIG.:5B
FIG.:5C
15
47
2A
48
45
46
44
18
12
24
25
26
27
23
13
2B

DEVICE FOR UNIT DISTRIBUTION OF THIN STACKED OBJECTS

FIELD OF THE INVENTION

The present invention relates to a device for unit distribution of thin stacked objects such as letters or the like.

Such a device, also called an unstacking device, comprises unstacking means such as a reduced-pressure drum for imparting acceleration to an object at the head of the stack and presenting it to a conveyor device which brings it to a processing, sorting or other station. Such a distribution device is, in particular, described in document FR-A-2,181,523.

An unstacking device should have a throughput which is as high as possible, but this objective raises a number of difficulties, because the dimensions, the weight and the materials of the thin objects are not uniform and can, within a stack, vary between certain limits. Thus, unstacking devices hitherto used in the field of mail sorting make it possible to obtain a throughput of ten letters per second with a conveyor speed of 3.2 meters per second, a step length of 320 mm and a maximum letter length of 210 mm.

SUMMARY OF THE INVENTION

The object of the invention is to provide a device for unit distribution of thin stacked objects which makes it possible to obtain a throughput of the objects which is substantially greater than that of devices of the prior art, whilst being very easy to use and requiring only a small number of operators to run it correctly.

For this purpose, the subject of the invention is a device for unit distribution of thin stacked objects, comprising unstacking means for imparting an acceleration to an object at the head of the stack, measurement means for measuring the instantaneous speed of the object at the head of the stack when it is ejected from the device by the unstacking means, and means for controlling the driving of the next object by the unstacking means as a function of speed data of the object at the head of the stack, provided by the measurement means.

Measuring the speed of the thin objects when they are ejected from the stacking device makes it possible to predict their movement and thus control the unstacking of the next object before the object being unstacked has left the unstacking device. By virtue of this possibility of controlling in anticipation the unstacking of the next object, the spacing between objects can be substantially reduced and the throughput increased.

According to one feature of the invention, the measurement means comprise at least one continuous speed measurement sensor including, for example, a rotary contact measurement feeler, arranged upstream of the unstacking means.

Preferably, the feeler comprises a roller with low inertia including an elastic tread with a high coefficient of friction. This tread makes it possible to take up the surface unevenness of the thin objects and to ensure rolling without sliding, so that the speed of rotation of the roller accurately reflects the instantaneous linear speed of the object being unstacked. The information on the speed of the objects can be supplied by a tacho-generator linked in rotation with the roller.

According to a preferred embodiment of the invention, the control means are designed to detect a decrease in the speed measured subsequently to the passage of the rear edge of an object being unstacked in front of the measurement means and to control the driving of the next object in a predetermined delay to be counted from the detection of speed decrease. Thus, detection of the rear edge of an object takes place when this object is still being unstacked, and not at the output of the distribution device, which makes it possible to control the unstacking of the next object by anticipation, whilst the correct execution of the unstacking taking place can be relied on because of the speed measurement carried out between the time when the object is set in motion and its rear edge is detected.

BRIEF DESCRIPTION OF THE DRAWINGS

FIGS. 5A to 5F are simplified diagrammatic views similar to FIG. 1, illustrating the unstacking device in various phases of operation.

DETAILED DESCRIPTION OF THE PREFERRED EMBODIMENT

Figure 1:
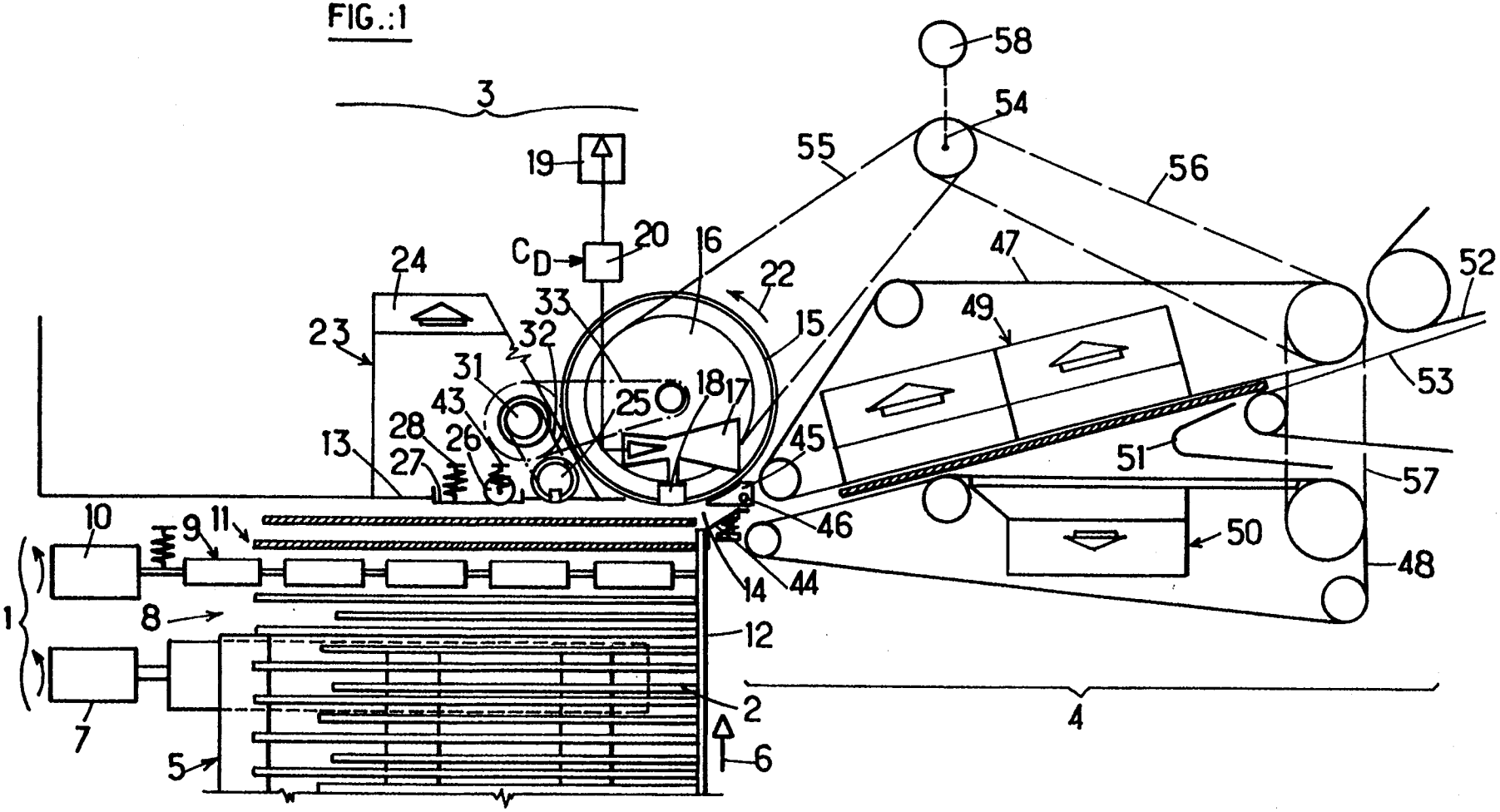
FIG. 1 is a diagrammatic plan view of a device for unit distribution of thin stacked objects according to a preferred embodiment of the invention, comprising an unstacking device, a feeder device and an output conveyor.
Figure 2:
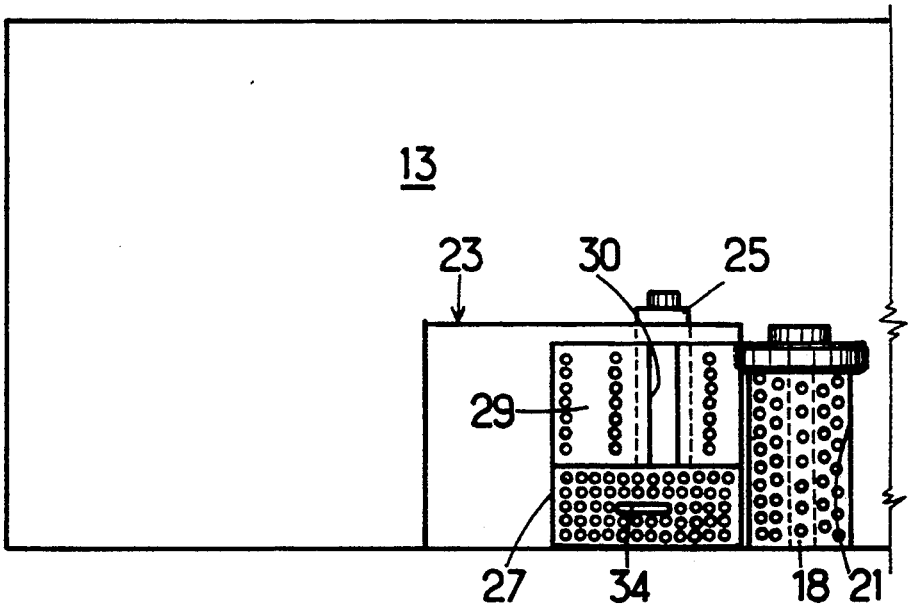
FIG. 2 is a partial view in front elevation of the unstacking device in FIG. 1.
Figure 3:
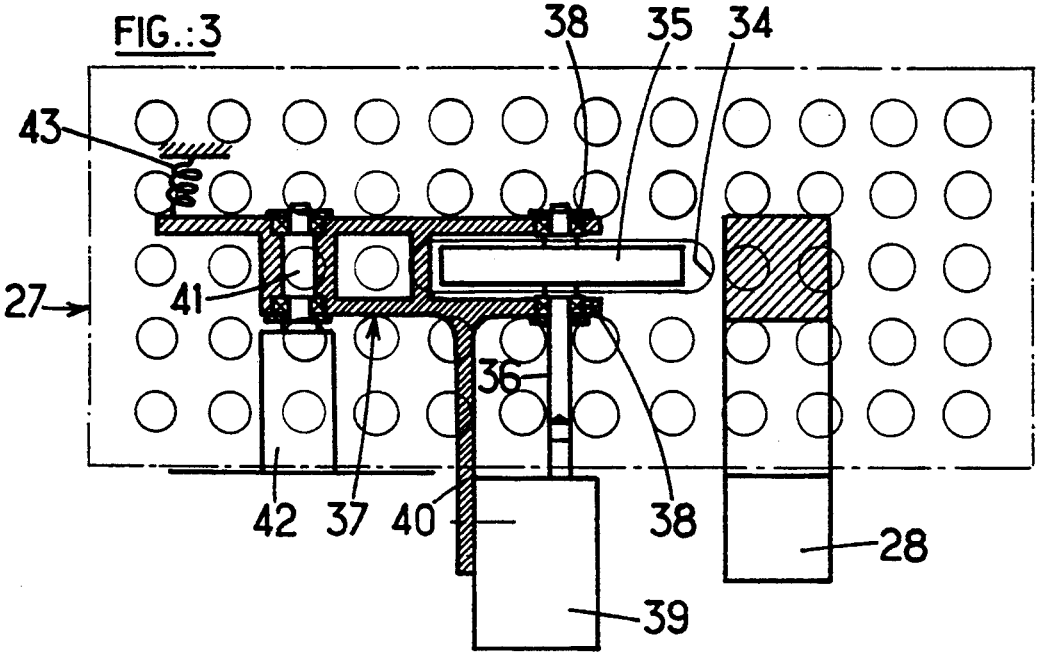
FIG. 3 is a partial view in front elevation on a larger scale of part of the support face of the unstacking device in FIG. 2.

Referring to FIGS. 1 to 3, a feeder device 1 brings a stack of thin objects 2, such as letters, to a unit distribution or unstacking device 3 which extracts them one by one from the stack to present them to an output conveyor 4, which brings them to a storage, processing or other station (not shown).

The feeder device 1 comprises a belt conveyor 5 moved in the direction indicated by the arrow 6 by an electric motor 7. At the output of the conveyor 5, the envelopes 2 arrive in a buffer region 8 where they are pushed against a roll 9 driven in rotation by an electric motor 10. The rotation of the roll 9 has the effect of driving the objects 2, which are then bearing against it, upward and of bringing them into a third region 11 where they rest in an uncompressed state on a step (not shown).

The feeder device 1 is described in more detail in French Patent Application No. 92 07801 filed on 25 Jun. 1992, which may be referred to.

The feeder device 1 includes a sidewall 12, henceforth termed the aligning edge, consisting of a metal sheet or the like with a low coefficient of friction, arranged vertically along the direction of the arrow 6 and stopping at a distance from a wall 13 constituting the support face of the unstacking device 3. The walls 12 and 13 thus form between them a slot 14 through which the thin objects are transferred from the head of the stack to the output conveyor 4. During operation, the objects 2 stacked on the conveyor 5 in principle bear via their front edge against the aligning edge 12.

The unstacking device 3 includes, as is conventional, a perforated drum 15 rotationally mounted around a cylindrical component 16 in which a chamber 17 is formed, which chamber is in communication, on the one hand, with a suction nozzle 18, and, on the other hand, with a reduced-pressure source 19, with a control solenoid valve 20 being placed between them. The nozzle 18 has the shape of a slot emerging through an opening centered on a radial plane in line with a window 21 made in the support wall 13, through which opening the drum 15 projects slightly. Thus, when the drum 15 turns in the direction indicated by the arrow 22, and a reduced pressure is applied to the nozzle 18 under control of the solenoid valve 20, a thin object bearing against the wall 13 is pressed flat against the surface of the drum moving in front of the nozzle 18 and is driven through the slot 14 toward the output conveyor 4. Preferably, the drum 15 is arranged as close as possible to the output 14 of the unstacking device, so as to be able to convey the objects 2 of the minimum allowable size at a nominal speed which is as high as possible, in order to maximize the throughput of the assembly 1, 3 and 4.

The wall 13 forms one of the faces of a suction chamber 23 connected to a reduced-pressure source 24. Immediately upstream of the drum 15, with respect to the direction of ejection of the objects 2, the suction chamber 13 accommodates a reduced-pressure realigning drum 25 as well as a speed sensor 26 mounted behind a perforated blade 27 which can execute small movements with respect to the wall 13 and is elastically constrained to project with respect thereto by means of a fastening member 28 such as a strain gauge, as described in the aforementioned French Patent Application No. 92 07801.

For the purpose of clarity, the realigning drum and the speed sensor 26 have been represented side by side on the diagrammatic view in FIG. 1. In practice, the realigning drum 25 is preferably mounted substantially above the speed sensor, as shown by FIG. 2. Thus, the moving perforated blade 27 is arranged below a perforated region 29 of the support wall 13, and an elongate vertical window 30 is formed in this region 29, in which window the perforated wall of the realigning drum 25 advances.

The realigning drum 25 is preferably of the type described in French Patent Application FR-A-2,657,856, to which reference may be made for a more detailed description. In accordance with the teaching of this document, the wall of the drum 25 is perforated in a limited angular sector of its circumference, and a reduced pressure is permanently applied to an internal nozzle situated in line with the window 30 through which the perforated part of the drum will project slightly when it is driven in rotation. The realigning drum 25 can be driven in rotation by the drum 15 using a clutch mechanism 31 which is connected, on the one hand, to the realigning drum 25 by a belt 32, and, on the other hand, to the drum 15 by a belt 33. The clutch mechanism 31 is for example of electromagnetic type.

Below the drum 25, the blade 27 is pierced by a horizontal aperture 34 through which, as FIG. 3 shows, a roller 35 constituting the feeler of the speed sensor 26 projects. This roller 35 is preferably a very lightweight rim surrounded by an elastic peripheral tread with a high coefficient of friction, allowing strong adhesion to the thin objects 2, and take-up of surface projections of the order of, for example, 1 mm. The roller 35 is linked in rotation with a vertical shaft 36 which is rotationally mounted between the yoke-shaped ends of a pivoting arm 37, by means of rolling bearings 38. The shaft 36 is solidly attached at its lower end to a suspended miniature tachometer 39 whose casing is fixed to a lug 40 extending vertically downward from the arm 37. The pivoting arm 37 is articulated part-way along its length about a vertical shaft 41 carried by a fixed support 42 and the end of the arm 37 opposite that carrying the roller 35 is fixed to a spring 43 tending to constrain the roller 35 to project through the aperture 34. Preferably, a friction shoe (not shown) is provided on the shaft 36 to ensure a static frictional couple and allow a defined drop in speed of the roller 35 when it is no longer in contact with a thin object 2.

The roller 35, and consequently the sensor 26, should be placed sufficiently close to the output 14 of the unstacking device 3 for an object of minimum allowable length to reach its nominal speed before its rear edge leaves the roller. On the other hand, the roller should be sufficiently far from the output 14 for the detection of the rear edge of the objects 2 by the sensor 26 (by detecting a drop in the speed of the roller 35, as will be explained below) to take place sufficiently in advance to predict the movement of the object being unstacked and to generate, before it actually leaves the unstacking device, the command for unstacking the next object, in order to overcome the various lags involved between the unstacking command and the setting of an object in motion. The position of the sensor 26 is therefore a functional compromise of the required running parameters.

Immediately downstream of the output slot 14 and upstream of the output conveyor 4, a shoe 44 is provided on either side of the path for conveying the thin objects, which shoe has at least one surface with a high coefficient of friction, and is elastically constrained against a fixed wedge-shaped block 45. The fixed block 45 has, facing the shoe 44, a surface with a low coefficient of friction, situated substantially in the extension of the wall 13 and substantially matches the curvature of the drum 15 on one of its sides. The shoe 44 is designed to be pushed back elastically on the side opposite the block 45 by the front edge of a thin object when the latter is being ejected by the unstacking drum 15.

The shoe 44 and block 45 device has the purpose of promoting separation of the object at the head of the stack from the next object during an unstacking sequence. Such a device is described in detail in French Patent Application FR-A-2,523,099 which may be referred to.

The block 45 carries a photoelectric cell 46 which has the purpose of detecting, at the output of the unstacking device 3, the passage of the front edge and of the rear edge of an object being unstacked.

The output conveyor 4 comprises a first section consisting of perforated belts 47 and 48 having lengths which are substantially parallel or slightly divergent over a first segment extending from the output 14 of the unstacking device 3, whereas in a second downstream segment the length of the belt 48 diverges substantially from the straight length of the belt 47. The straight length of the belt 47 advances in front of suction chambers which are denoted in their entirety by the reference 49, whereas, in the second segment, the divergent length of the belt 48 advances in front of the suction chambers 50. A V-shaped deflector 51 is arranged downstream of the point of divergence of the opposite lengths of the belts 47 and 48 and allows the thin objects to be guided, on one side towards a second section of the output conveyor, consisting of belts 52 and 53, and, on the other side, towards a recycling station (not shown).

Thus, in the event that two thin objects are simultaneously taken up by the conveyor 4 at the output of the unstacking device 3, one of the objects remains pressed flat against the belt 47 under the effect of the reduced pressure existing in the chambers 49 and is conveyed toward the section 52, 53 of the conveyor, whereas the other object pressed flat against the belt 48 by the chamber 50 and guided by the deflector 51 is diverted out of the main path to be recycled.

The drum 15 and the perforated belts 47 and 48 are driven in rotation from a common electric motor 54 via respective drive belts 55, 56 and 57. Preferably, the motor 54 is coupled to a tacho-generator 58 which makes it possible to measure and control the speeds of the drum 15 and of the belts 47 and 48 very accurately. Preferably, the peripheral speed of the drum 15 is a few percent less than the speed of the belts 47 and 48.

Figure 4:
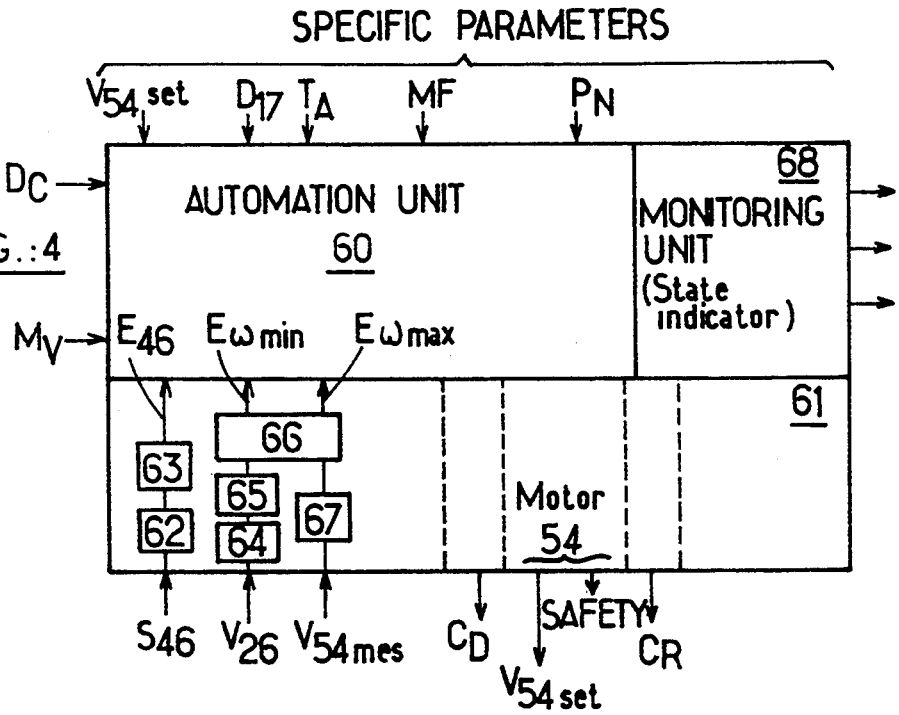
FIG. 4 is a block diagram illustrating the structure and the inputs/outputs of a device for managing the distribution device in FIGS. 1 to 3.

Referring to FIG. 4, reference 60 denotes a programmable automation unit allowing selective control of the application of a reduced pressure to the drum 15 and the driving of the realigning drum 25, as a function of programmed parameters and information supplied by the speed sensor 26 and the cell 46. Box 61 denotes an interface between the sensors and actuators and the automation unit 60. Box 68 is a monitoring unit controlled by the automation unit 60 to indicate the abnormal states of operation of the unstacking device 3 to an operator.

A certain number of specific parameters are stored in the automation unit 60, namely:

the set-point speed $V_{54set}$ of rotation of the motor 54 which determines the speed of the drums 15 and 25 and of the belts 47 and 48;

the reduced pressure $D_{17}$ applied to the chamber 17;

the duration $T_A$ of the square waves applied to the solenoid valve 20 in order to control the application of a reduced pressure to the chamber 17;

the various modes of operation of the unstacking device, which may be chosen selectively by the users, namely a constant step-length mode managed by detection of the front edge of an object by the cell 46, a non-predictive constant-interval mode managed by detection of the rear edge of an object by the cell 46, and a preferred predictive constant-interval mode managed by detection of the rear edge of an object in the unstacking device using the speed sensor 26; and the nominal operating step-length $P_N$.

Inputs $D_C$ and $M_V$ allow control respectively of step-by-step running of the unstacking device and its empty running.

Box 61 is an interface between the automation unit 60 and the sensors and actuators of the unstacking device 1. The interface 61 receives the output signal $S_{46}$ of the cell 46 which, after filtering and formatting at 62 and 63, forms a logic signal $E_{46}$ which takes the logic state 1 or 0 depending on whether or not there is a thin object in front of the cell.

The speed signal $V_{26}$ provided by the sensor 26, after filtering at 64 and gain alteration at 65, is compared in a windowed comparator 66 with the speed signal $V_{54mes}$ supplied by the tacho-generator 58 associated with the motor 54, after alteration of the signal $V_{54mes}$ at 67. The windowed comparator 66 compares the speed measured by the roller 35 with threshold values $\omega_{min}$ and $\omega_{max}$ which are a function of the speed of rotation imparted to the drum 15 by the motor 54. The windowed comparator produces a first logical signal $E_{\omega min}$ which has the level 0 when the measured speed of the roller 35 is less than the threshold $\omega_{min}$, and the level 1 in the opposite case, and a second logic signal $E_{\omega max}$ which takes the value 0 when the measured speed of the roller 35 is less than the threshold $\omega_{max}$, and the value 1 in the opposite case.

The interface 61 also alters the signals necessary for commands of the various actuators, namely:

the solenoid valve 20 to which an unstacking command signal $C_D$ is applied; and the motor 54 to which a set-point speed $V_{54set}$ and a signal for enabling/disabling a safety is applied; and the clutch mechanism 31 to which a signal $C_R$ is applied, allowing it to be locked in order to drive the drum 25 with a view to realigning the front edge of a thin object not driven by the drum 15.

The operation of the entire unstacking device 3 according to the preferred predictive constant-interval mode will now be described with reference to FIGS. 5A to 5F.

FIG. 5A shows the unstacking device when a thin object $2_A$ is being ejected by the unstacking drum 15. The next object $2_B$ of the stack is being pressed flat against the blade 27 under the effect of the suction force exerted in the chamber 23. The roller of the sensor 26 is rotationally immobilized by its contact with the object $2_B$ which it progressively pushes back into the chamber as the object $2_B$ becomes pressed flat against the support wall 13.

In FIG. 5B, the object $2_B$ is in the initial unstacking position, that is to say that it is pressed flat against the support wall 13 under the effect of the suction existing in the chamber 23 and that it thus pushes back the blade 27 and the roller of the sensor 26 in the plane of the wall 13. The front edge of the object $2_B$ is in the aligning position, namely in the plane of the edge 12 and in immediate proximity to the shoe 44.

When a reduced pressure is applied in the nozzle 18 by controlling the solenoid valve 20, the object $2_B$ is pressed flat against the drum 15 (gripping phase), then accelerated by this drum to the nominal speed before pinching between the belts 47 and 48 of the output conveyor, as represented in FIG. 5C.

During this phase of acceleration between a zero speed (FIG. 5B) and the nominal speed (FIG. 5C), the sensor 26 continuously measures the speed of the object and supplies this information to the automation unit 60. When the rear edge of the object $2_B$ escapes from the roller 35 of the speed sensor 26, the speed of rotation of this roller decreases sharply because of its low inertia and, optionally, of the friction shoe provided on its shaft 36. By virtue of the processing carried out at 64, 65 and 66, the passage of the rear edge of the object $2_B$ past the sensor 26 is detected when the speed measured by the sensor 26 falls below the set-point value $\omega_{max}$. This detection makes it possible to start up in anticipation, in a determined delay, the unstacking of the next object, as will be described with regard to FIG. 6. Clearly, the speed sensor must be placed sufficiently near to the aligning edge 12 for, under normal operating conditions and for objects having the minimum allowable length, the speed of the roller 35 to reach the value $\omega_{max}$ before the rear edge of the object is presented in front of the speed sensor.

In FIG. 5D, the object $2_B$ is exiting the unstacking device 3 at the nominal speed fixed by the motor 54, and a new object $2_C$ is in the position for it to be unstacked.

FIG. 5E shows an object $2_M$ being unstacked when the next object $2_N$ bearing against the wall 13 has an aligning fault: its front edge is substantially away from the aligning edge 12 and no part of the object $2_N$ is situated in line with the nozzle 18, so that, at the next unstacking sequence, the object $2_N$ will not be driven by the unstacking drum 15. This fault is detected by the fact that, after sending an unstacking control square-wave to the solenoid valve 20, the roller 35 of the sensor 26 does not reach the set-point value $\omega_{min}$ within a predetermined delay. In consequence, the automation unit 60 commands locking of the clutch mechanism 31, so as to cause the realigning drum 25 to rotate through one turn. This drum, whose surface is perforated over a given angular sector, thus causes controlled movement of the object $2_N$ over a length measured by the speed sensor 26, which length is, for example, at most 30 mm. In the event of a fault in the driving of the object $2_N$ by the unstacking drum 15 in the next unstacking sequence, the realigning process is repeated until the object has advanced sufficiently (FIG. 5F) for it then to be driven by the drum 15. In the event of an unstacking fault after a given number of realigning sequences, the monitoring unit 68 associated with the automation unit 60 generates a realigning fault message.

Figure 6:
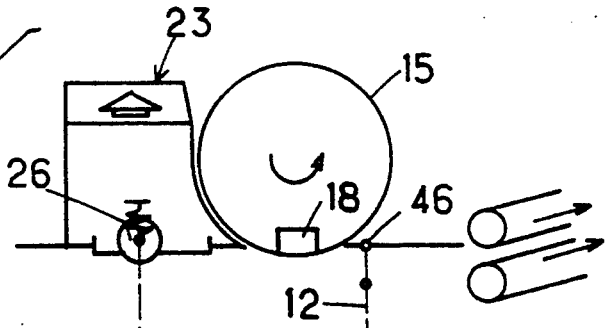
FIG. 6 is a state transition diagram which is combined with a diagrammatic plan view of the unstacking device and illustrates the various unstacking sequences employed using the managing device in FIG. 4.

FIG. 6 illustrates various states $P_1$ to $P_6$ of the automation unit 60 for different positions of an object 2, which positions are labelled with respect to the unstacking device 3 (whose realigning drum 25 has not been represented, for the sake of clarity).

In the initial state $P_1$, the object 2 is ready to be unstacked, its front edge being assumed to be in or near the plane of the aligning edge 12. The cell 46 detects no object and the roller 35 is immobilized. The signals $E_{46}$, $E_{\Omega min}$ and $E_{\omega max}$ are consequently in the logic state 0. When an unstacking command signal $C_D$ is applied to the solenoid valve 20, the automation unit 60 triggers a time delay $T_1$ which is a function, in particular, of the nominal step-length $P_N$ and of lags $R_t$ and $t_r$.

Figure 7:
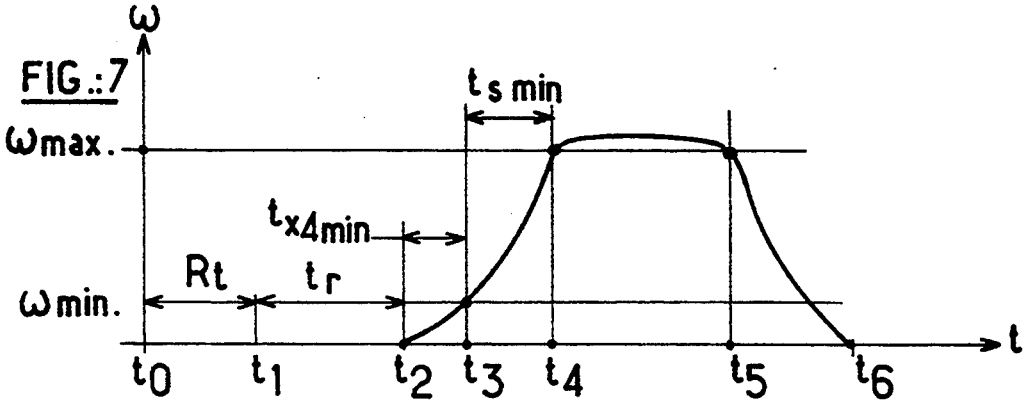
FIG. 7 is a diagram illustrating the change as a function of time in the speed of a feeler in contact with a thin object during part of the unstacking phase.

These lags are illustrated by FIG. 7 which shows the change in the speed of the roller 35 starting from the instant $t_0$ when a control square-wave $C_D$ is applied to the solenoid valve 20. In this diagram, $R_t$ represents a pure lag corresponding to the time separating the instant of application of the control square-wave to the solenoid valve 20 from that of actual establishment of the reduced pressure in the nozzle 18; $t_r$ represents the delay which separates the instant of actual establishment of the reduced pressure in the nozzle 18 from the instant of actual driving of an object 2 by the drum 15.

Time delay $T_1$ of the state $P_1$ represents the delay in which the command for unstacking the object 2 should occur after the rear edge of the preceding object has been detected by the speed sensor 26. If the unstacking command $C_D$ does not occur before the end of the time delay $T_1$, the monitoring unit 68 emits an operational fault signal.

In the following state $P_2$, the front edge of the object 2 is detected by the cell 46 and the signal $E_{46}$ changes from level 0 to level 1. The detection of the front edge should occur in a delay $T_2$ which is a function of the lag $R_t$ and of the time necessary for the front edge of an object of maximum allowable weight to pass from the position $P_1$ to the position $P_2$. If the front edge is not detected within the delay $T_2$, the monitoring unit 68 emits an operational fault signal.

At the instant $t_3$ (FIG. 7) corresponding to the state $P_3$, the roller 35 reaches the speed $\omega_{min}$ and the signal $E_{\omega min}$ changes from level 0 to level 1. If this change in logic state of the signal $E_{\omega min}$ does not occur within a delay $T_3$ to be counted from the instant $t_0$, the automation unit generates a realigning sequence as previously described with reference to FIGS. 5E and 5F.

At the instant $t_4$ corresponding to the state $P_4$, the roller 35 reaches the speed $\omega_{max}$ and the signal $E\omega_{max}$ changes from level 0 to level 1. This change in logic state of the signal $E_{\omega max}$ should occur in a delay $T_4$ which is the maximum allowable delay for changing from speed $\omega_{min}$ (instant $t_3$) to speed $\omega_{max}$ (instant $t_4$). If the change in logic state does not occur within this delay $T_4$, the monitoring unit 68 emits an operational fault signal.

At the instant $t_5$, corresponding to the state $P_5$, the rear edge of the object 2 leaves the roller 35 and the speed of this roller falls back below the value $\omega_{max}$. The signal $E_{\Omega max}$ returns from state 1 to state 0. This change in logic state should occur in a delay $T_5$ to be counted from the instant $t_0$, or else an operational fault signal is generated by the monitoring unit 68.

From this start $t_5$ of detection of the rear edge of an object at the roller 35, the automation unit commands, after a suitable delay, unstacking of the next object by anticipating the subsequent movement of the object 2 being unstacked.

Finally, the state $P_6$ corresponds to the detection by the cell 46 of the rear edge of the object 2 being unstacked. This detection causes the signal $E_{46}$ to return from level 1 to level 0, after the signal $E_{\omega min}$ has returned from level 1 to level 0 between the states $P_5$ and $P_6$. The detection of the rear edge of the unstacked object by the cell 46 should occur within a maximum delay $T_6$ to be counted from the instant $t_0$.

By way of example, the unstacking device which has just been described makes it possible to produce a throughput of 20 letters per second at a speed of five meters per second for letters of length lying between 125 and 265 mm, with a mean length of 200 mm. By virtue of the prediction of the movement of the objects being unstacked and the anticipated command of unstacking the next object, which can be ensured by the device according to the invention, the spacing between consecutive objects can be reduced to 50 mm, i.e. a time separation of 7 milliseconds, compared to 35 milliseconds for the device of the state of the art referred to at the start of the present description.

It is obvious that the embodiment described is only an example, and that it might be modified, in particular by substituting equivalent techniques, without thereby departing from the scope of the invention.

I claim:

1. Device for unit distribution of thin stacked objects, comprising an outlet for the unit ejection of said objects from said device, unstacking means for accelerating an object at the head of the stack downstream through said outlet, measurement means for measuring the instantaneous speed of said object at the head of the stack when it is unstacked through said outlet by said unstacking means, said measurement means comprising at least a speed sensor located upstream of said outlet, and means for controlling the driving of the next object by said unstacking means as a function of speed data of said object at the head of the stack provided by said measurement means.

2. Device according to claim 1, wherein said speed sensor is a continuous speed measurement sensor arranged upstream of said unstacking means.

3. Device according to claim 2, wherein said sensor comprises a rotary feeler for measuring speed by contact.

4. Device according to claim 3, wherein said feeler is linked in rotation with a tacho-generator.

5. Device according to claim 3, wherein said feeler is carried by a moving arm and is constrained by elastic means to project beyond a face for supporting the head of said stack in said device.

6. Device according to claim 2, wherein said feeler comprises a roller with low inertia including an elastic tread with a high coefficient of friction.

7. Device according to claim 1, wherein said unstacking means comprise a rotary reduced-pressure drum arranged between said speed measurement means and a sidewall for supporting the front edge of said thin objects.

8. Device according to claim 7, comprising a reduced-pressure realigning drum arranged upstream of said rotary unstacking drum, said realigning drum being driven by said control means to execute a driving movement of predetermined amplitude if, at the end of a predetermined delay after the actuation of said unstacking means, the speed measured by said measurement means remains less than a predetermined minimum value.

9. Device according to claim 1, comprising, at the outlet of said device, detection means capable of detecting the leading edge of an object being unstacked, said control means being designed to detect a running fault in the absence of detection of said leading edge in a predetermined delay after the actuation of said unstacking means.

10. Device according to claim 9, wherein said control means are designed to detect a running fault in the absence of detection by said detection means, in a predetermined delay after the actuation of said unstacking means, of the trailing edge of said object being unstacked.

11. Device according to claim 9, wherein said detection means comprise at least one photoelectric cell.

12. Device according to claim 1, wherein said control means are designed to detect a decrease in said speed measured subsequently to the passage of the rear edge of an object being unstacked in front of said measurement means and to control said driving of the next object in a predetermined delay to be counted from said detection of speed decrease.

13. Device according to claim 12, wherein said control means are designed to detect said decrease in speed by comparing the speed measured by said measuring means with a predetermined maximum speed.

14. Device according to claim 1, wherein said control means comprise a programmable automation unit connected to said measurement means and managing said unstacking means.

* * * * *